US008689712B2

(12) United States Patent
Maramotti

(10) Patent No.: US 8,689,712 B2
(45) Date of Patent: Apr. 8, 2014

(54) METHOD FOR JOINING TWO FABRIC PORTIONS, A MULTILAYER STRUCTURE AND AN ARTICLE OF CLOTHING

(71) Applicant: Max Mara S.R.L. Societa' Unipersonale, Reggio Emilia (IT)

(72) Inventor: Lulgi Maramotti, Albinea (IT)

(73) Assignee: Max Mara S.R.L. Societa' Unipersonale, Reggio Emilia (IT)

( * ) Notice: Subject to any disclaimer, the term of this patent is extended or adjusted under 35 U.S.C. 154(b) by 0 days.

(21) Appl. No.: 13/713,752

(22) Filed: Dec. 13, 2012

(65) Prior Publication Data

US 2013/0157002 A1 Jun. 20, 2013

(30) Foreign Application Priority Data

Dec. 15, 2011 (IT) ..... MO2011A0324

(51) Int. Cl.
*D05B 3/12* (2006.01)

(52) U.S. Cl.
USPC ..... 112/475.17

(58) Field of Classification Search
USPC ..... 112/475.01, 475.17, 475.24, 475.26, 112/402, 405, 415, 417, 418, 421–428, 440, 112/441; 2/275
See application file for complete search history.

(56) References Cited

U.S. PATENT DOCUMENTS

| | | | | | |
|---|---|---|---|---|---|
| 2,264,224 | A | * | 11/1941 | Swan | 442/244 |
| 2,719,803 | A | * | 10/1955 | Nottebohm | 2/131 |
| 3,333,280 | A | * | 8/1967 | Hynek et al. | 2/143 |
| 5,003,902 | A | * | 4/1991 | Benstock et al. | 112/418 |
| 5,090,615 | A | * | 2/1992 | Hopkins et al. | 229/125.35 |
| 6,079,343 | A | * | 6/2000 | Wong | 112/475.09 |
| 7,005,021 | B2 | * | 2/2006 | Kramer | 156/73.4 |
| 8,402,566 | B2 | * | 3/2013 | Stubiger | 2/275 |
| 2006/0096511 | A1 | | 5/2006 | Zhang et al. | |
| 2007/0264894 | A1 | | 11/2007 | Lerner | |
| 2010/0269245 | A1 | | 10/2010 | Stubiger | |

FOREIGN PATENT DOCUMENTS

| | | | |
|---|---|---|---|
| DE | 10 2007 050 174 | B3 | 2/2009 |
| EP | 1 568 808 | A1 | 8/2005 |
| FR | 2 368 565 | A1 | 5/1978 |
| GB | 479 374 | A | 2/1938 |
| GB | 794 822 | A | 5/1958 |
| GB | 1 554 158 | A | 10/1979 |
| GB | 2 018 573 | A | 10/1979 |
| WO | 03/032763 | A1 | 4/2003 |

* cited by examiner

*Primary Examiner* — Danny Worrell
(74) *Attorney, Agent, or Firm* — Pearne & Gordon LLP

(57) ABSTRACT

A method including:

providing a portion of double cloth including a first layer joined to a second layer, the layers being joined by a two-dimensional distribution of joining threads obtained by weaving;

detaching the first layer from the second layer along an edge zone of the double cloth, to define on the first layer a band in which the first layer is separated from the second layer;

cutting the band of the first layer, so that the second layer exhibits a projecting strip which projects with respect to a free edge of the first layer;

arranging a further portion of fabric in contact with the second layer;

joining the further portion of fabric to the second layer by a joining line arranged along the projecting strip;

after the step of joining, turning the further portion of fabric, to move the further portion of fabric away from the second layer.

13 Claims, 2 Drawing Sheets

Fig. 4
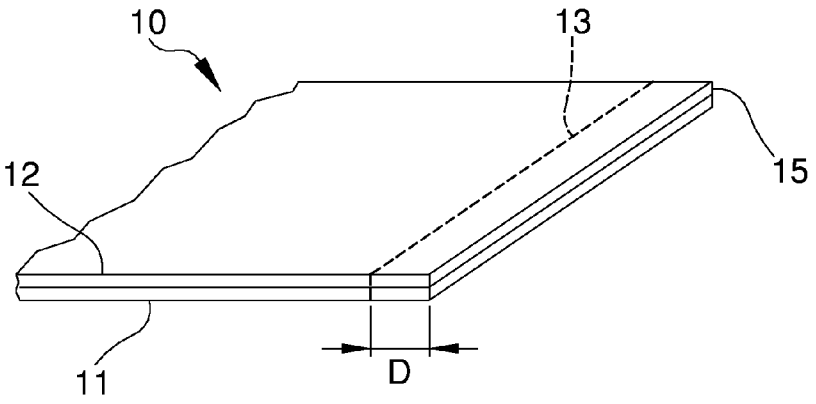
Fig. 5
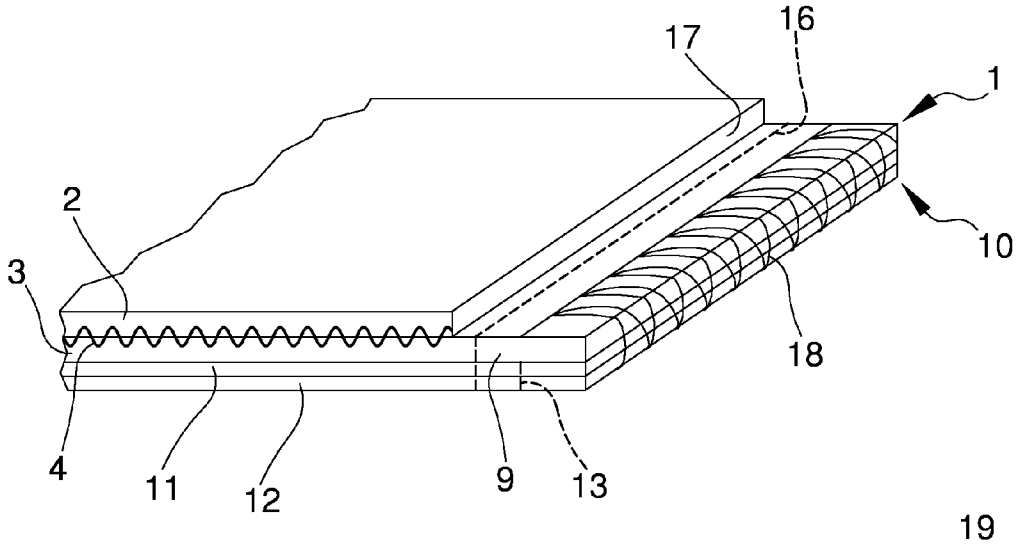
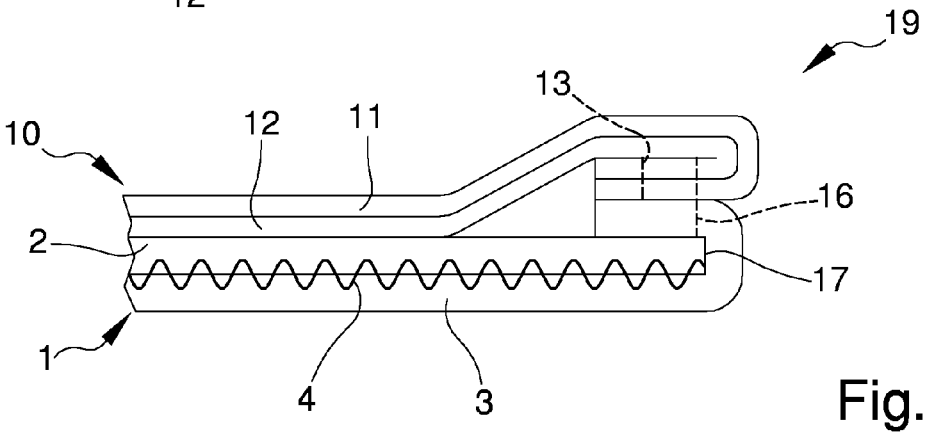
Fig. 6

METHOD FOR JOINING TWO FABRIC PORTIONS, A MULTILAYER STRUCTURE AND AN ARTICLE OF CLOTHING

The invention relates to a method for joining two fabric portions so as to obtain a multilayer fabric structure. The method according to the invention is particularly suitable for joining the two fabric portions, one of which is formed by a double cloth, along a perimeter hem of a garment. The invention further relates to a fabric structure comprising two fabric portions joined together. In addition, the invention relates to an article of clothing obtained with the above-mentioned fabric structure.

For the manufacture of coats, jackets and other heavy garments of high quality, it is known to use a so-called "double cloth", that is, a fabric made up of two layers of cloth joined to each other by means of a two-dimensional distribution of joining threads. The two-dimensional distribution of joining threads, which is obtained by weaving, joins the two layers of material forming the double cloth along the entire contact surfaces where the layers are facing each other.

When it is desired to make a perimeter hem on a double cloth, it is known to separate the two layers forming the double cloth along an edge zone, thus originating two strips of fabric detached from each other. The detached strips are then folded up toward the inside of the double cloth and joined together with hand-sewn stitches.

Although the method disclosed above provides good results when a perimeter hem is made in a single double cloth, such a method is not suitable for making a perimeter hem in a multilayer fabric structure made up of a double cloth superimposed upon a different type of fabric, for example a lining. In this case, the known method would induce the operator to fold up towards the inside both the double cloth and lining, and then join together the edges of the double cloth and lining thus folded.

Thus, a multilayer fabric structure would be obtained exhibiting a number of defects.

Firstly, along the perimeter hem the multilayer structure would have a large thickness, corresponding to the sum of the thicknesses of two double cloths and two linings.

Furthermore, the essence of the double cloth would be lost, since the multilayer structure obtained would seem to be made up of a lining and a normal heavy fabric, rather than a lining and a high-quality double cloth. Finally, sewing the stitches by hand between the folded up lining and folded up double cloth so as to achieve aesthetically pleasing results would be difficult, if not impossible, since it would be practically impossible to prevent the stitches sewn on the lining from being visible.

WO 03/032763 discloses a garment free of wrinkles and a method for manufacturing such garment. The method can in particular be applied for manufacturing shirt collars. The collar is manufactured from a multilayer structure comprising a first collar component, a second collar component, a bonding element and an interlining. The interlining overlaps the first collar component and stops short of the edge of the first collar component. The first collar component is then joined to the second collar component and to the bonding element by means of a seam which does not pass through the interlining. At this point, the bonding element and the first collar component are folded in a direction around the seam, while the second collar component is folded in the other direction around the seam.

WO 03/032763 does not relate to a double cloth, i.e. a cloth made up of two fabric layers joined to one another by means of a two-dimensional distribution of joining threads obtained by weaving, the joining threads being distributed along the whole contact surfaces at which the layers face one another. The double cloth is formed as a multilayer cloth already during the weaving step.

On the contrary, WO 03/032763 relates to a fabric formed by a single layer. A plurality of distinct fabric layers, such as the first collar component, the second collar component, the interlining and the bonding element, are superimposed to one another when the garment is manufactured and only in particular zones of the garment.

The skilled person wishing to improve the methods for joining a portion of double cloth to another portion of fabric would not take into consideration the disclosure of WO 03/032763, which does not even mention the double cloth.

An object of the invention is to improve the known methods for joining a portion of double cloth to a further portion of fabric, particularly for the purpose of making a perimeter hem.

Another object is to provide a method for joining a portion of double cloth to a further portion of fabric along a junction area, without excessively increasing the thickness of the junction area.

A further object is to provide a method for joining together a portion of double cloth and a further portion of fabric, wherein the double cloth is not deprived of its essence.

A still further object is to provide a method for joining a portion of double cloth to a further portion of fabric which enables aesthetically pleasing results to be obtained also when the double cloth must be joined to a lightweight fabric such as a lining.

In a first aspect of the invention, there is provided a method comprising the steps of:

- providing a portion of double cloth comprising a first layer joined to a second layer, the first layer being joined to the second layer by means of a two-dimensional distribution of joining threads obtained by weaving;
- detaching the first layer from the second layer along an edge zone of the double cloth, so as to define on the first layer a band in which the first layer is separated from the second layer;
- cutting said band of the first layer, so that the second layer exhibits a projecting strip which projects with respect to a free edge of the first layer;
- arranging a further portion of fabric in contact with the second layer;
- joining the further portion of fabric to the second layer by means of a joining line arranged along the projecting strip;
- after the step of joining, turning the further portion of fabric, such as to move the further portion of fabric away from the second layer.

By positioning the joining line along the projecting strip, i.e. in a region of the double cloth in which only one layer is present, it is possible to reduce the thickness of the portion of double cloth in the area in which said portion is joined to the further portion of fabric. This enables the thickness of the junction between the two fabric portions to be reduced, so that the junction is very pleasing both aesthetically and to the touch.

Furthermore, the essence of the double cloth is not lost, because the two-layer configuration of the double cloth is used in a particular manner to join the double cloth to the further fabric.

In addition, the portion of double cloth can be joined to the further portion of fabric by means of a simple joining line disposed along the projecting strip, without having to fold up edges of fabric toward the inside. A high quality result is thus obtained, since the junction between the two fabrics is very clean and linear, and has no full areas and empty areas that would create non-aesthetic undulations.

Adopting a linear machine-sewn seam as a joining line renders lengthy and not easy hand sewing operations superfluous.

Finally, since the further portion of fabric is joined to the portion of double cloth simply by means of a joining line, the method according to the first aspect of the invention is suitable for being used also to join lightweight fabrics such as linings to the double cloth. The method according to the first aspect of the invention is inventive over the method disclosed in WO 03/032763. Even if the skilled person took into consideration WO 03/032763, which is not realistic, the skilled person would be prompted by WO 03/032763 to introduce additional elements besides the fabrics to be joined, such as the interlining and the bonding element. This solution would be unfeasible in connection with a double cloth like the one referred to in the method according to the first aspect of the invention, because the addition of the interlining and of the bonding element would involve an excessive thickness increase in an area where the fabric portions to be joined overlap. The method according to the first aspect of the invention requires actions that are opposite to the actions required by the method disclosed in WO 03/032763. The method according to the first aspect of the invention requires that a component, namely a band of the first fabric layer, be cut, instead of adding a component, as required by WO 03/032763. There is no teaching in WO 03/032763 which would prompt the skilled person to remove a part of a fabric. On the contrary, WO 03/032763 only prompts to add additional fabric layers. In a second aspect of the invention, there is provided a multilayer fabric structure, comprising a portion of double cloth and a further portion of fabric, the portion of double cloth comprising a first layer and a second layer that are in contact with one another at respective contact surfaces, the first layer being joined to the second layer by means of joining threads distributed two-dimensionally along the whole contact surfaces, the second layer having a projecting strip which projects with respect to a free edge of the first layer, wherein the further portion of fabric is joined to the second layer by means of a joining line arranged along the projecting strip.

The multilayer fabric structure provided in the second aspect of the invention is simple to realize and very pleasing, both aesthetically and to the touch.

In a third aspect of the invention, there is provided a method comprising the steps of:

- providing a portion of double cloth comprising a first layer joined to a second layer, the second layer having a projecting strip which projects with respect to a free edge of the first layer;
- arranging a further portion of fabric in contact with the second layer;
- joining the further portion of fabric to the second layer by means of a joining line arranged along the projecting strip;
- optionally, after the joining step, rotating the further portion of fabric so as to move the further portion of fabric away from the second layer.

In a fourth aspect of the invention, there is provided a multilayer fabric structure comprising a portion of double cloth and a further portion of fabric, the portion of double cloth comprising a first layer joined to a second layer, the second layer having a projecting strip which projects with respect to a free edge of the first layer, wherein the further portion of fabric is joined to the portion of double cloth by means of a joining line arranged along the projecting strip.

The invention can be better understood and carried out with reference to the appended drawings, which illustrate an example and non-limitative embodiment thereof, in which:

FIG. 4 is an enlarged schematic perspective view showing a further portion of fabric;

FIG. 5 is a view like the one in FIG. 3, showing a further step of the method for joining two fabric portions;

FIG. 6 is an enlarged schematic side view showing a multilayer structure obtained by joining two fabric portions.

Figure 1:
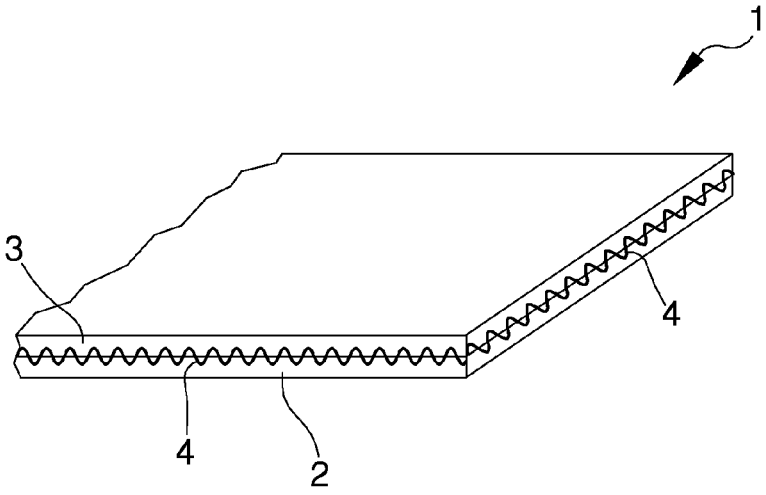
FIG. 1 is an enlarged schematic perspective view showing a portion of double cloth.

FIG. 1 schematically shows, in an enlarged view, a portion of double cloth 1. The double cloth comprises a first layer 2 and a second layer 3, which are both made of fabric. In particular, the first layer 2 and second layer 3 are generally made with the same type of fabric having the same colour and pattern, or, optionally, different colours and/or patterns. The first layer 2 and the second layer 3 can be made with fabrics having weights suitable both for spring and autumn/winter.

The first layer 2 has a contact surface which faces a further contact surface of the second layer 3. A joining arrangement is provided for joining the first layer 2 to the second layer 3 so as to form the double cloth. The joining arrangement is two-dimensionally distributed in such a way that the first layer 2 is joined to the second layer 3 along the entire extension of the respective contact surfaces. In this manner, the first layer 2 and second layer 3 form a single body over the whole of their extension. If a user handles the double cloth, he or she does not have the impression that it consists of two distinct layers of material, since he or she cannot separate the first layer 2 and second layer 3 from each other, not even in the respective intermediate regions.

The joining arrangement can comprise a two-dimensional distribution of joining threads 4. The joining threads 4 engage with the first layer 2 and with the second layer 3, defining between the first layer 2 and second layer 3 a plurality of joining stitches evenly distributed along the entire extension of the contact surfaces of said layers.

The two-dimensional distribution of joining threads 4 is obtained by weaving.

Figure 2:
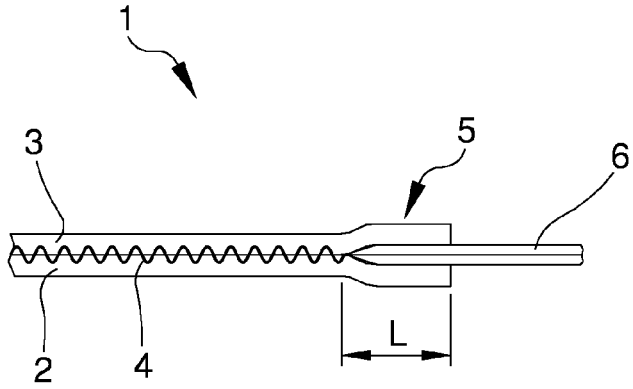
FIG. 2 is an enlarged schematic side view showing an initial step of a method for joining two fabric portions.

The double cloth shown in FIG. 1 can be joined to other layers of fabric by using a method of which FIG. 2 shows an initial step.

In this initial step, which can be defined as a separation step, the first layer 2 and second layer 3 which form the portion of double cloth 1 are separated from each other along an edge zone 5. This can be done by using a separator device, comprising, for example, a blade 6, which is inserted between the first layer 2 and second layer 3 along the edge zone 5, so that the joining threads 4 that interact with the blade 6 are broken.

The blade 6 is rotatable around a vertical rotation axis, not illustrated. The portion of double cloth 1 is brought near the blade 6 so that the latter penetrates between the first layer 2 and the second layer 3 and, as it rotates, cuts the joining threads 4. After the joining threads 4 arranged in the edge zone 5 have been cut, the portion of double cloth 1 is moved away from the blade 6.

After interacting with the blade 6, the first layer 2 and second layer 3 will be detached from each other in a detachment region arranged along the edge zone 5, while they will still be joined to each other in the remaining areas.

The detachment region along which the first layer 2 and second layer 3 are separated from each other has a width L, as shown in FIG. 2. The width L can be selected as desired, depending on needs and/or the features of the double cloth. In general, the width L ranges from 10 to 20 mm. The width L is constant along the edge zone 5 of the portion of double cloth 1.

Figure 3:
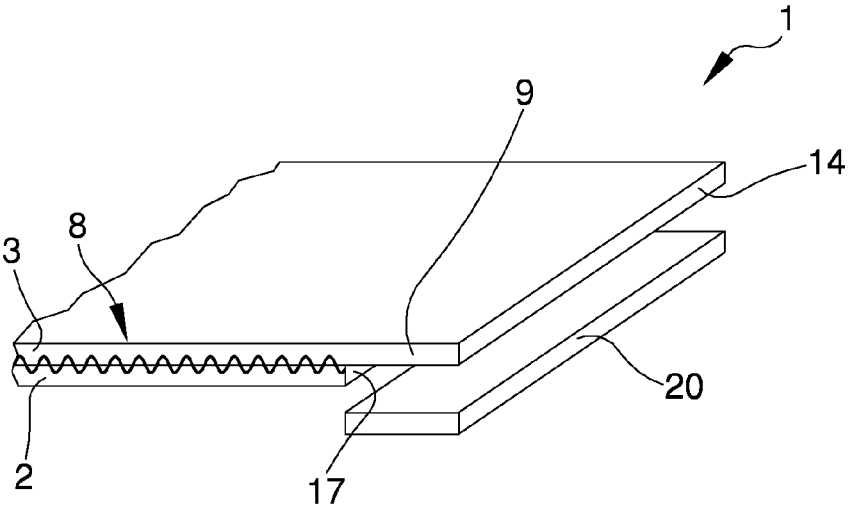
FIG. 3 is an enlarged schematic perspective view showing a step of the method which follows the step shown in FIG. 2.

Subsequently, a cutting step is carried out, the result of which is shown in FIG. 3.

During the cutting step, the first layer 2 is trimmed along the detachment region in which the first layer 2 is detached from the second layer 3. In other words, a band 20 of the first layer 2—along which the first layer 2 is detached from the second layer 3—is cut. The band 20 cut from the first layer 2 has a width that is substantially equal to the width L of the detachment region.

On the first layer 2 there is thus defined a free edge 17, from which the band 20 has been cut.

The band 20 of the first layer 2 is cut manually so as to increase the cutting precision and ensure that the line along which the band 20 is cut is as close as possible to the boundary of the area in which the first layer 2 is still joined to the second layer 3.

At the end of the cutting step, on the portion of double cloth 1 there is thus defined a joining area 8 along which the first layer 2 is still joined to the second layer 3, and a projecting strip 9 that projects relative to the joining area 8. In other words, the projecting strip 9 projects relative to the free edge 17 of the first layer 2.

The projecting strip 9 has a monolayer structure, since it is made up of the cloth of the second layer 3.

FIG. 4 shows a further portion of fabric 10, which has been prepared in order to be joined to the portion of double cloth 1. In the embodiment represented in FIG. 4, the further portion of fabric 10 has a multilayer structure. In particular, the further portion of fabric 10 comprises a layer 11 and a further layer 12.

The layer 11 can be made of nylon, for example of the type commonly used to obtain linings.

The further layer 12 can be made with a polyester-based or polyamide-based fabric. The further layer 12 can be a layer of functional fabric having particular technical properties, e.g. windproof or non-drip properties. In one embodiment, the further layer 12 can be made of a calendered fabric. Calendering enables the fibres forming the further layer 12 to be flattened. These fibres, which originally had a substantially circular cross section, thus acquire a flattened cross section, for example an oval or elliptical one. This makes it possible to reduce the dimensions of the interstices defined between the weft and warp of the fabric forming the further layer 12 and thus to limit the passage of air through the further layer 12 to a substantial degree. Good windproof properties can thus be imparted to the further layer 12.

The layer 11 and further layer 12 are placed one on top of the other and joined along a joining line that can be defined by a seam 13.

The seam 13 is substantially parallel to an edge 15 of the further portion of fabric 10 and is arranged at a distance D from said edge.

Subsequently, as shown in FIG. 5, the portion of double cloth 1 and the further portion of fabric 10 are arranged in contact with each other. In particular, the portion of double cloth 1 and the further portion of fabric 10 are placed one on top of the other in such a way that the seam 13 is substantially parallel to a longitudinal edge 14 of the projecting strip 9. The region of the further portion of fabric 10 in which the seam 13 has been made is in contact with the projecting strip 9. The longitudinal edge 14 of the projecting strip 9 can be aligned with the edge 15 of the further portion of fabric 10.

In the embodiment shown in FIG. 5, the layer 11 is placed in contact with the portion of double cloth 1 so as to be interposed between the further layer 12 and the portion of double cloth 1.

The portion of double cloth 1 is then joined to the further portion of fabric 10 by means of a joining line configured as a seam line 16.

The seam line 16 passes through the further portion of fabric 10 and the second layer 3 of the portion of double cloth 1, without interacting, however, with the first layer 2 of the portion of double cloth 1. The seam line 16 is obtained on the projecting strip 9, parallel to the free edge 17 of the first layer 2. The seam line 16 is arranged in a position that is as close as possible to the free edge 17. In particular, the seam line 16 is positioned at a distance of less than 3 mm from the free edge 17.

This makes it possible to conceal the seam line 16 in such a way that the thickness thereof is not perceivable, even to the touch, when the fabric is picked up and handled, because the free edge 17 prevents the seam line 16 from being noticed.

As shown in FIG. 5, the seam line 16 is interposed between the seam 13 and the free edge 17. The seam 13 is in turn interposed between the seam line 16 and the edge 15.

An overlock 18 is also created to join the edge 15 of the further portion of fabric 10 and the longitudinal edge 14 of the projecting strip 9, with a stitch density that is sufficient to prevent fraying of said edges. The portion of double cloth 1 is now joined to the further portion of fabric 10.

After being joined to the portion of double cloth 1, the further portion of fabric 10 can be rotated so as to be moved away from the second layer 3. This is done by gripping the further portion of fabric 10 in a region arranged on the opposite side of the edge 15 relative to the joining line 16.

The further portion of fabric 10 can be rotated in such a manner as to be at least partially facing the first layer 2. In this case, the rotation of the further portion of fabric 10 is almost 360°.

When the further portion of fabric 10 is rotated, the projecting strip 9 will also be drawn in rotation, since the projecting strip 9 is joined to the further portion of fabric 10.

In the embodiment represented, the further portion of fabric 10 is rotated around the seam line 16. The projecting strip 9 is in turn rotated around the free edge 17.

As a result of the rotation, the projecting strip 9 goes into contact against the surface of the first layer 2 opposite the second layer 3. The further portion of fabric 10 rests against the first layer 2. In particular, the further layer 12 of the further portion of fabric 10 is in contact with the first layer 2.

A multilayer fabric structure 19 is thus obtained, as schematically shown in an enlarged view in FIG. 6, and it can be used to make various types of garments.

Owing to the above-described embodiment of the method for joining two fabric portions, the portion of double cloth 1 and the further portion of fabric 10 are joined in a junction area intended to define a perimeter hem of a garment. The projecting strip 9 and the band of the further portion of fabric 10 in contact with the projecting strip 9 form a seam allowance along the perimeter hem thus obtained.

The multilayer fabric structure 19 can be used in particular to make coats, jackets or other heavy garments.

In the example illustrated, the second layer 3 defines a face of the multilayer fabric structure 19. The further portion of fabric 10 defines a further face of the multilayer fabric structure 19, said further face being opposite said face.

The seam line 16 is arranged at one end of the multilayer fabric structure 19, that is, along an edge of the multilayer fabric structure 19, so that the second layer 3 and the further portion 10 define two opposite faces.

The above-described method for joining the portion of double cloth 1 to the further portion of fabric 10 makes it possible to obtain a multilayer structure 19 that is of particularly high quality from an aesthetic viewpoint. In fact, when the projecting strip 9 and the further portion of fabric 10 are folded up along the free edge 17 as shown in FIG. 6, there are no visible seams in the multilayer structure 19.

Furthermore, the portion of double cloth 1 is joined to the further portion of fabric 10 with a limited overlapping of fabrics, thus avoiding excessive thicknesses in the junction area.

The hand sewing operations are practically eliminated, which makes it possible to obtain a method for joining two fabric portions that is particularly simple and fast to implement, even for operators who are not extremely expert.

Moreover, it is no longer necessary to fold up the edges of the double cloth toward the inside, which simplifies the procedure for joining the two fabric portions and prevents the formation of unaesthetic undulations.

Finally, since the joining line which joins the portion of double cloth 1 to the further portion of fabric 10 is a simple seam line 16, the above-described method makes it possible to join even very lightweight fabrics, such as a lining, to the double cloth.

In the article of clothing made with the multilayer fabric structure 19, the double cloth can be arranged toward the outside relative to the person who wears the article of clothing, so as to be visible. The layer 11 can instead be turned toward the inside so as to be positioned in contact with the body of the person who wears the article of clothing and consequently act as a lining. The further layer 12 will thus be interposed between the layer 11 and the double cloth so as to impart the desired technical properties to the article of clothing.

In one embodiment, the article of clothing made with the multilayer fabric structure 19 can be reversible, so that it can be worn either with the double cloth on the outside or with the double cloth on the inside, turned toward the user's body. The multilayer fabric structure 19 is particularly suitable for making reversible articles of clothing, since there are no visible seams joining the portion of double cloth 1 to the further portion of fabric 10. From an examination of the junction area between the fabric portions 1, 10 it is therefore not possible to establish univocally a front and back of the article of clothing made with the multilayer fabric structure 19.

In an unillustrated embodiment, instead of having a multilayer configuration the further portion of fabric 10 can be made up of a single layer of fabric. This fabric could be, for example, of the type usually used for linings, or of another type.

Furthermore, the multilayer fabric structure 19 could also be used to make articles of clothing other than the above-mentioned jackets and coats.

The invention claimed is:

1. A method comprising the steps of:

providing a portion of double cloth comprising a first layer joined to a second layer, the first layer being joined to the second layer by means of a two-dimensional distribution of joining threads obtained by weaving;

detaching the first layer from the second layer along an edge zone of the double cloth, so as to define on the first layer a band in which the first layer is separated from the second layer;

cutting said band of the first layer, so that the second layer exhibits a projecting strip which projects with respect to a free edge of the first layer;

arranging a further portion of fabric in contact with the second layer;

joining the further portion of fabric to the second layer by means of a joining line arranged along the projecting strip;

after the step of joining, turning the further portion of fabric, such as to move the further portion of fabric away from the second layer.

2. A method according to claim 1, wherein the first layer is detached from the second layer by introducing therebetween a blade for breaking a plurality of threads of said two-dimensional distribution of joining threads.

3. A method according to claim 1, wherein the free edge is defined on the first layer when the band is cut, such that the projecting strip projects from a side of the free edge and a joining area extends on another side of the free edge, the first layer being joined to the second layer in the joining area.

4. A method according to claim 1, wherein the step of turning brings the further portion of fabric to face at least partially the first layer.

5. A method according to claim 1, wherein, during the step of turning, the projecting strip rotates about the free edge and the further portion of fabric rotates about the joining line up to being superposed on the first layer.

6. A method according to claim 1, wherein the joining line is parallel to the free edge.

7. A method according to claim 1, wherein the joining line is arranged at a distance of less than 3 mm from the free edge.

8. A method according claim 1, wherein the joining line is a seam line.

9. A method according to claim 1, wherein the further portion of fabric is formed by at least two layers.

10. A method according to claim 9, wherein said at least two layers are joined to one another by a seam which is placed in contact with the projecting strip in a position interposed between the joining line and an edge of the further portion of fabric, during the step of arranging.

11. A method according to claim 1, wherein the further portion of fabric comprises a layer of a lining and a further layer of a functional fabric, the further layer of functional fabric being positioned in contact with the second layer during the step of arranging.

12. A method according to claim 11, wherein the functional fabric is a calendered fabric.

13. A method according to claim 1, and further comprising a step of overlocking in which a longitudinal edge of the projecting strip is joined to an edge of the further portion of fabric.

* * * * *